US009016347B2

(12) United States Patent
Lin

(10) Patent No.: US 9,016,347 B2
(45) Date of Patent: Apr. 28, 2015

(54) LOOPED-CORD SYSTEM FOR WINDOW COVERINGS

(75) Inventor: Tzong-Fu Lin, Taipei (TW)

(73) Assignee: Whole Space Industries Ltd., Taipei (TW)

( * ) Notice: Subject to any disclaimer, the term of this patent is extended or adjusted under 35 U.S.C. 154(b) by 814 days.

(21) Appl. No.: 13/240,143

(22) Filed: Sep. 22, 2011

(65) Prior Publication Data

US 2013/0079186 A1 Mar. 28, 2013

(51) Int. Cl.

| | |
|---|---|
| ***A47H 1/00*** | (2006.01) |
| ***E06B 9/324*** | (2006.01) |
| ***E06B 9/326*** | (2006.01) |
| *E06B 9/325* | (2006.01) |

(52) U.S. Cl.

CPC ..... *E06B 9/324* (2013.01); *E06B 9/325* (2013.01); *E06B 9/326* (2013.01)

(58) Field of Classification Search

USPC ..... 160/298, 307, 308, 321

See application file for complete search history.

(56) References Cited

U.S. PATENT DOCUMENTS

| | | | | |
|---|---|---|---|---|
| 1,128,204 | A * | 2/1915 | Wharton | 160/298 |
| 2,109,112 | A * | 2/1938 | Hanson | 160/298 |
| 2,577,046 | A * | 12/1951 | Svirsky | 160/321 |
| 3,253,645 | A * | 5/1966 | Stall | 160/344 |
| 3,462,095 | A | 8/1969 | Hilsinger, Jr. et al. | |
| 5,279,473 | A | 1/1994 | Rozon | |
| 5,354,011 | A | 10/1994 | Rozon | |
| 5,762,281 | A | 6/1998 | Foley | |
| 5,791,580 | A | 8/1998 | Anderson et al. | |
| 6,745,969 | B1 | 6/2004 | Gouda | |
| 8,695,680 | B2 * | 4/2014 | Cannaverde | 160/321 |
| 2008/0251622 | A1 | 10/2008 | Randall et al. | |
| 2010/0258664 | A1 | 10/2010 | Twork | |

* cited by examiner

*Primary Examiner* — Blair M Johnson

(74) *Attorney, Agent, or Firm* — Buchanan Ingersoll & Rooney PC

(57) ABSTRACT

A looped-cord system includes a beaded cord having a set of beads connected in series to form a loop with a space between each pair of adjacent beads. In one embodiment a stop sized to fit within the space between a pair of adjacent beads is attached to a housing. A resilient finger located opposite the stop pushes a portion of the beaded cord adjacent to and not engaging the sprocket against the stop so the stop is within a space between a pair of adjacent beads, thereby preventing movement of the cord loop. Applying tension to the cord loop overcomes the resilient finger and moves the cord away from the stop enabling movement of the cord loop. In another embodiment a key engages the sprocket preventing the sprocket from turning until tension is applied to the cord loop by proper installation of the tensioner on the cord loop.

19 Claims, 6 Drawing Sheets

LOOPED-CORD SYSTEM FOR WINDOW COVERINGS

FIELD OF THE INVENTION

The present invention relates generally to looped-cord mechanisms of the type commonly used in window coverings and treatments, such as blinds, curtains, and the like. More particularly, the present invention relates to a looped-cord mechanism that can be attached to a shaft in the headrail which does not operate the window covering unless the cord tensioner has been properly mounted to a wall or other non-moveable structure.

BACKGROUND OF THE INVENTION

Many types of architectural coverings and treatments, such as Venetian blinds, cellular or pleated shades, and variants of these utilize an actuator known as a looped-cord or continuous looped-cord. Such cords are distinct from the basic pull cord style shades in that the looped-cord does not connect directly to the shade material, but rather engages a clutch on a rotating shaft in a headrail of the shade. Movement of the looped-cord in a first direction operates that clutch to accumulate shade material when opening, and movement of the looped-cord in a second direction lets out shade material. The looped-cord may be made at different lengths than the shade and may be configured to make multiple circulations during opening and closing of the shade. Often a beaded cord is used in a looped-cord drive. The benefits of a looped-cord system versus a standard pull cord system are that the exposed cord loop remains at a constant length whether the shade is open or closed (avoiding the problem of stowing the long exposed pull cord when the shade is opened). Moreover, a looped-cord system also provides a mechanical advantage to raise relatively large, heavy shades with reasonable cord forces.

However, looped-cord systems also have a significant disadvantage. The cord loop may hang freely along a side of the shade which is operated by the looped-cord system. Many looped-cord systems have been installed such that the cord loop extends to or below the bottom of the window and the cord is easily grasped by young children. A dangling cord loop has proved to be a health hazard to young children. In recent years, cases of death or injury have been documented in which a small child has become entangled in a cord loop and has choked or become asphyxiated when the cord became wrapped around the child's neck and constricted the child's airway. All of these incidents involved looped-cord systems which did not have a cord tensioner or the cord tensioner was not attached to the wall and the cord loop hung freely.

Current safety regulations in the United States require that looped-cord style shades be supplied with a tensioner. A tensioner typically includes a two-piece housing with a through passage for a cord and is configured for attachment to a wall or other fixed structure. A properly installed tensioner pulls the cord loop downward away from the headrail so that the cord is taut when used to raise and lower a blind and when not in use. When the cord is taut it should be difficult to spread the two runs of the cord loop apart a sufficient distance for a child's head to fit within the loop, thereby preventing injury and possibly death. However, some tensioners have been installed with a dangerous amount of slack in the cord loop and some tensioners have not been installed at all.

To minimize the limitations of known tensioners, improved tensioner designs have been developed. One design includes a tensioning spring between a cord contacting member and a tensioner mounting body. This improved design allows the tensioner to be mounted with the cord loop fully taut and the tensioning spring partially loaded. The pre-loaded spring holds the cord loop taut while not in operation, thus preventing a young child from spreading the cord loop wide enough to pass his or her head through the loop. During operation of the looped-cord system, an adult operating the cord will be able to overcome the remainder of the spring loading and easily pull the cord to open or close the shade. However, even this improved tensioner design has not fully addressed the safety concerns associated with the looped-cord systems because there is no requirement that the tensioner be installed for the shade to be operable. The end user may elect not to mount the tensioner to the wall or other non-moveable structure and instead use the tensioner as a weight at the bottom of the cord loop. Although new tensioner designs include safety improvements, if the tensioner is not mounted to the wall, as discussed above, it will not prevent the opening of the cord loop to a dangerous width.

Therefore, a need exists for a looped-cord system which will prevent the window covering from being raised and lowered if the tensioner has not been properly installed.

BRIEF SUMMARY OF THE INVENTION

A looped-cord system has a housing, a sprocket attached to the housing and a beaded cord loop hung from the sprocket. The beaded cord has a set of beads connected in series to form a loop with a space between each pair of adjacent beads. In a present preferred embodiment of my looped-cord system a stop is attached to the housing. The stop is sized to fit within the space between a pair of adjacent beads. A resilient finger is located opposite the stop and pushes a portion of the beaded cord adjacent to and not engaging the sprocket against the stop such that the stop is within a space between a pair of adjacent beads, thereby preventing movement of the beaded cord loop. Applying tension to the cord loop will overcome the pushing of the resilient finger and move the beaded cord away from the stop enabling movement of the beaded cord loop.

A second present preferred embodiment is similar to the first embodiment and includes a second resilient finger and stop.

In a third present preferred embodiment a moveable key is provided which is movable from a first position in which the key is within a space between a pair of adjacent beads to a second position in which the key is spaced away from the beaded cord. A spring or other bias member acts on the key to move the key into a space between a pair of adjacent beads in the cord loop preventing the beaded cord loop from moving around the sprocket. The key may be on the end of a resilient finger. The resilient finger causes the beaded cord loop to be pressed against a wall or stop such that the beaded cord loop does not hang freely and will not move. A downward force acting on the cord loop when a tensioner is properly installed will pull the beaded cord away from the wall or stop enabling the cord to move so that the beaded cord loop may move around the sprocket.

In a fourth embodiment the key engages the sprocket, rather than the beaded chain, preventing the sprocket from turning. When the key is so positioned the beaded cord loop does not hang freely, but us pressed inward or outward by an arm connected to the key. A downward force acting on the cord loop when a tensioner is properly installed will pull the corded bead loop such that an arm or arms connected to the key will move disengaging the key from the sprocket enabling the beaded cord to move around the sprocket.

Other variations and advantages of the present invention will become apparent from a description of certain present preferred embodiment thereof shown in the drawings.

DETAILED DESCRIPTION OF THE PREFERRED EMBODIMENTS

Figure 1:
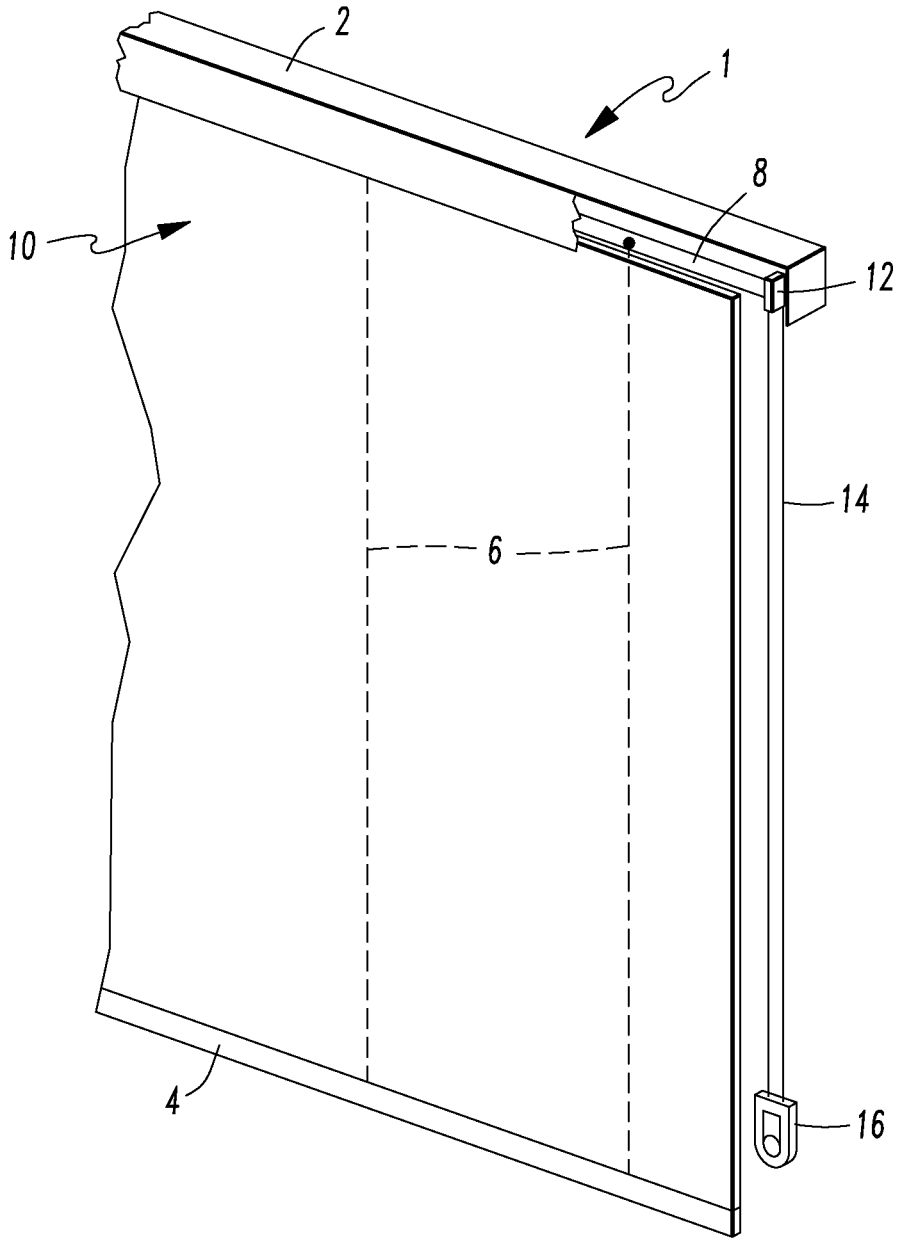
FIG. 1 PRIOR ART
FIG. 1 is a front perspective view of a window covering having a cord loop drive and tensioner of the type known in the art and in which the present cord loop drive can be used.

Referring to FIG. 1, there is shown a partial view of a window covering 1 which is operated by a looped-cord system. The window covering includes a window covering material 10 extending between a headrail 2 and a bottom rail 4. Headrail 2 is mounted above a window or other opening (not shown) such that the window covering material 10 hangs vertically to cover the window. Lift cords 6 extend from a shaft 8 in the headrail through or across the window covering material 10 to the bottom rail 4. Rotation of the shaft 8 collects or plays out the lift cords 6 to raise or lower the window covering material 10 and attached bottom rail 4. Shaft 8 is connected to a cord loop drive 12. Cord loop 14 does not connect directly to shaft 8 but rather turns a sprocket attached to the shaft 8. A clutch (not shown) may be provided between the sprocket and the shaft. Cord loop 14 may be a different length than shade 10 and may be configured to make multiple circulations during operation of sprocket. A looped-cord tensioner 16 is mounted to a wall or other non-movable structure adjacent to shade 10. Among other benefits, the window treatment design shown in FIG. 1 includes a constant length of exposed cord loop 14 (avoiding the problem of stowing a long exposed cord found in pull-cord style window treatment designs while the treatment is open). Moreover, cord loop 14 and sprocket cooperatively provide a mechanical advantage to raise relatively large, heavy shades with reasonable force on the cord loop.

A major disadvantage of the looped-cord drive systems in the prior art is that the window covering can be raised and lowered when the tensioner is not attached to the wall.

I provide a looped-cord system which will not allow the window covering material to be raised and lowered if the tensioner is not properly installed and can be used in place of any current looped-cord system known in the art.

Figure 2:
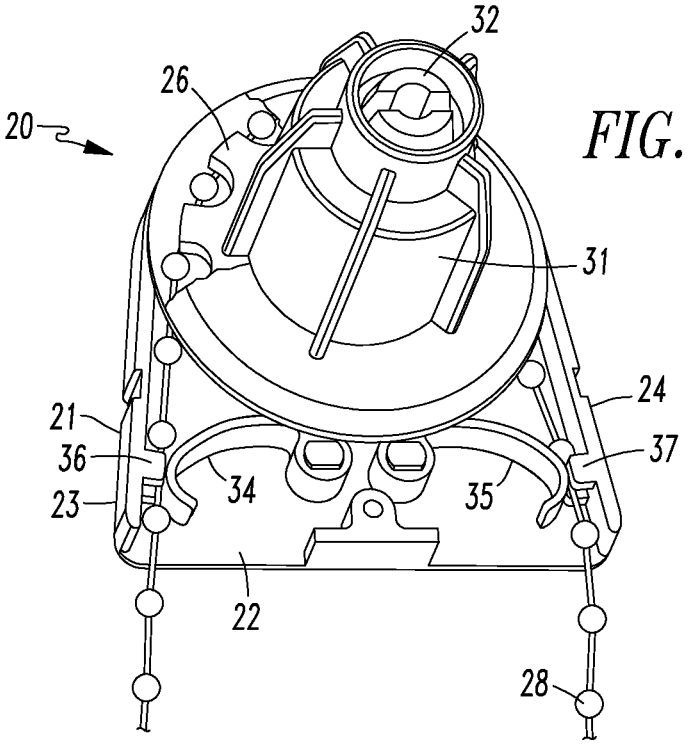
FIG. 2 is a perspective end view of a first present preferred embodiment of a cord loop drive for my looped-cord system when the tensioner has not been properly installed.
Figure 3:
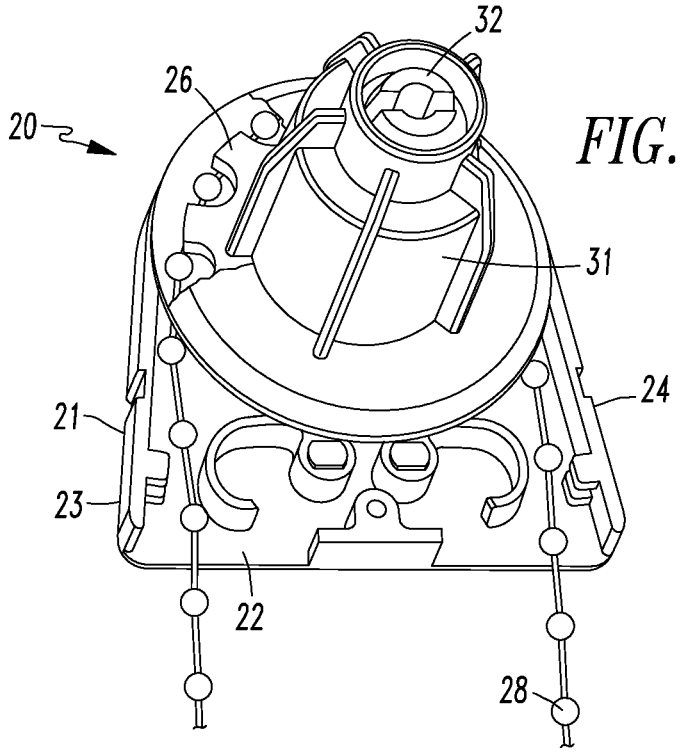
FIG. 3 is a perspective end view of the embodiment shown in FIG. 2 when the cord tensioner has been properly installed.

In a first present preferred embodiment of my looped-cord system I provide a drive unit 20 shown in FIGS. 2 and 3. The drive unit 20 has a housing 21 which has a base 22 and opposite side walls 23 and 24 extending outward from the base. A sprocket 26 is mounted on the base 22. A beaded cord loop 28 extends around the sprocket such that pulling the beaded cord will cause the sprocket 26 to rotate. A clutch 31 is connected to and carried on the sprocket. The clutch has an opening 32 which receives a shaft to which the lift cords are connected. Such a shaft may be similar to shaft 8 shown in FIG. 1. A pair of resilient fingers 34 and 35 is attached to the housing. As can be seen in FIG. 2 the resilient fingers extend outwardly pressing the beaded cord loop 28 against stops 36 and 37 when a tensioner on the beaded cord loop has not been properly installed. When the beaded loop cord is in this position shown in FIG. 2 these stops prevent the beaded cord loop from moving. Consequently, the sprocket 26 will not move and the shaft attached to the sprocket will not turn. When the beaded cord loop 28 is in this position the window covering is inoperable as it cannot be raised or lowered. When the tensioner is properly installed the tensioner will pull the beaded cord loop 28 away from the sprocket 26 such that the beaded cord loop 28 and fingers 34 and 35 are positioned as shown in FIG. 3. Because the fingers have moved away from the stops 36 and 37 the beaded cord loop 28 is no longer restrained and can move freely. Consequently, the sprocket 26 can be turned to operate the shaft which raises and lowers the window covering.

Figure 4:
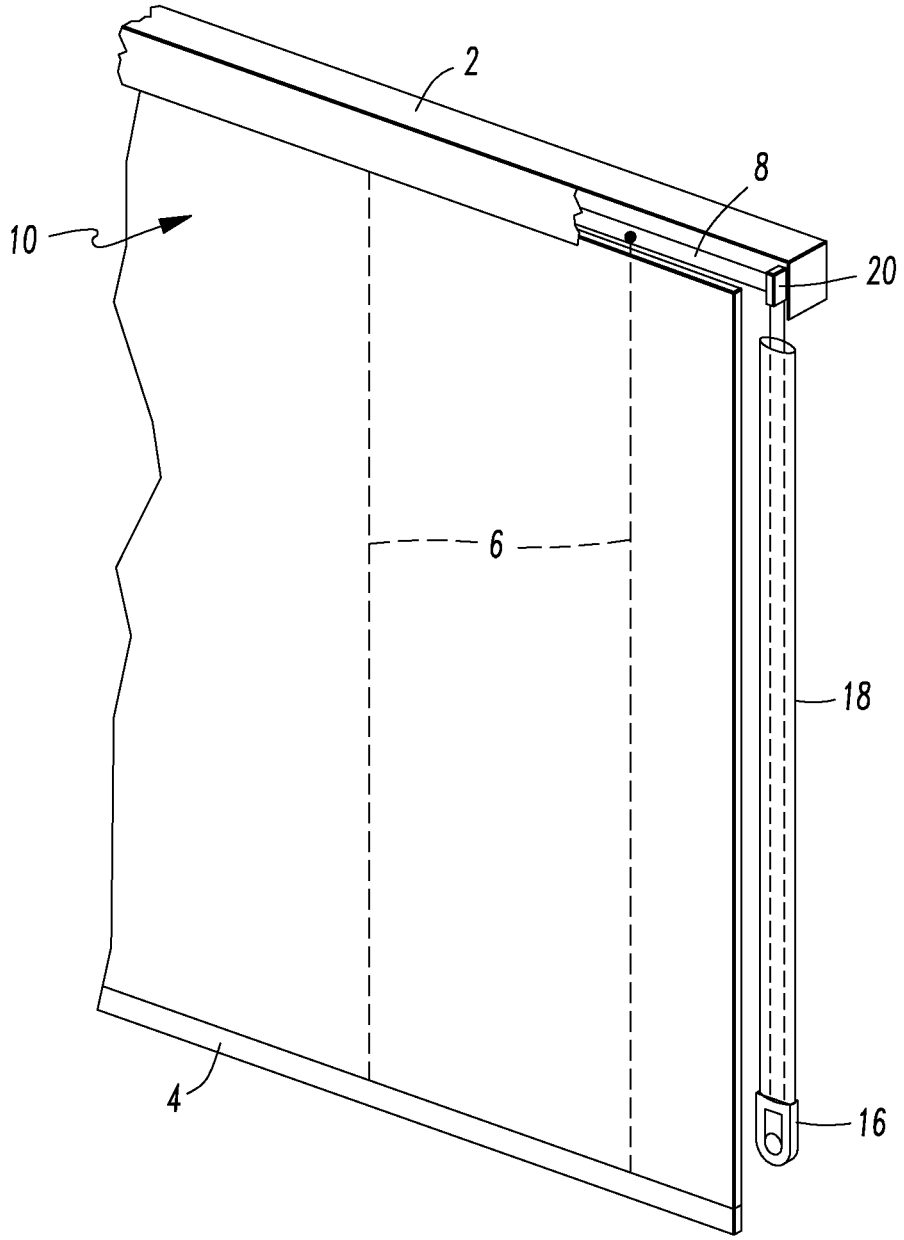
FIG. 4 is a front perspective view of a window covering with my looped-cord system which may contain the cord loop drive shown in FIGS. 1 and 2 and having a cord shroud.

As shown in FIG. 4 I prefer to provide a shroud 18 around the cord loop. The shroud extends from a headrail 2 to the tensioner 16. The shroud can be made of fabric material or film. I prefer to use a fabric that can be stretched. Preferably the shroud has one end attached to the housing for the cord loop drive and the opposite end attached to the tensioner. The shroud prevents access to the cord loop both before and after the tensioner has been installed.

Figure 5:
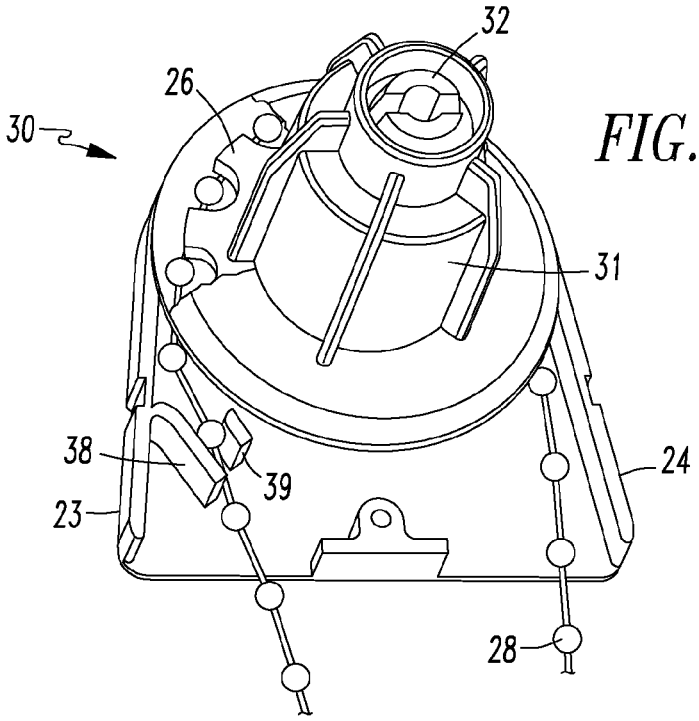
FIG. 5 is a perspective end view of a second preferred embodiment of a cord loop drive when the tensioner has not been properly installed.
Figure 6:
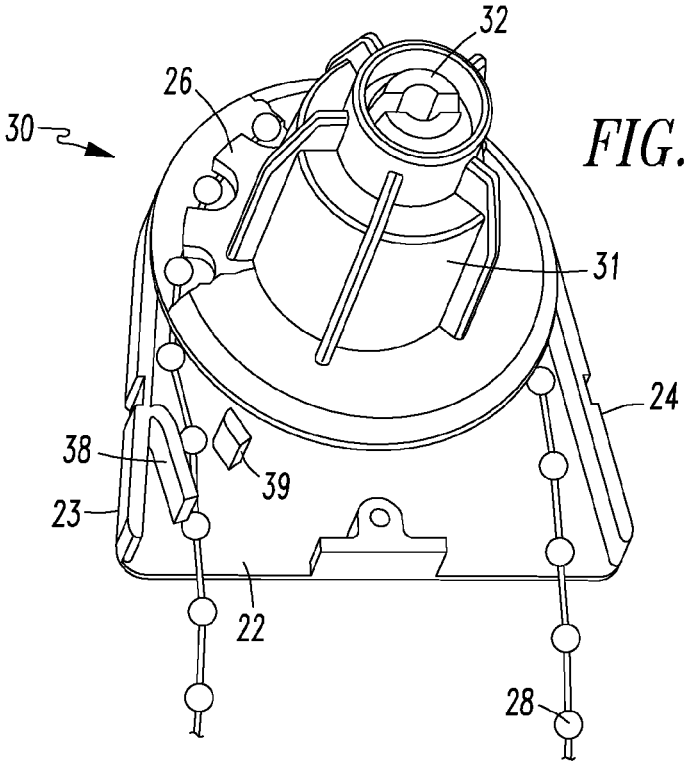
FIG. 6 is a perspective end view of the embodiment shown in FIG. 5 when the tensioner has been properly installed.

A second present preferred embodiment of a looped-cord drive for my of my looped-cord system is shown in FIGS. 5 and 6. This looped-cord drive 30 is similar in construction to the embodiment shown in FIGS. 2 and 3. However, there is a single resilient finger 38 is connected to the sidewall 23. When the tensioner is not properly installed as in FIG. 5 the resilient finger 38 will push the bead chain against stop 39. Acting in cooperation with the stop 39 the key prevents movement of the beaded cord loop preventing rotation of the sprocket and operation of the blind. If desired one could provide a slot (not shown) in the finger or a projection or key on the finger that will fit between a pair of adjacent beads in the beaded cord loop 28 when the finger 38 presses the loop 28 against the stop 39.

Figure 7:
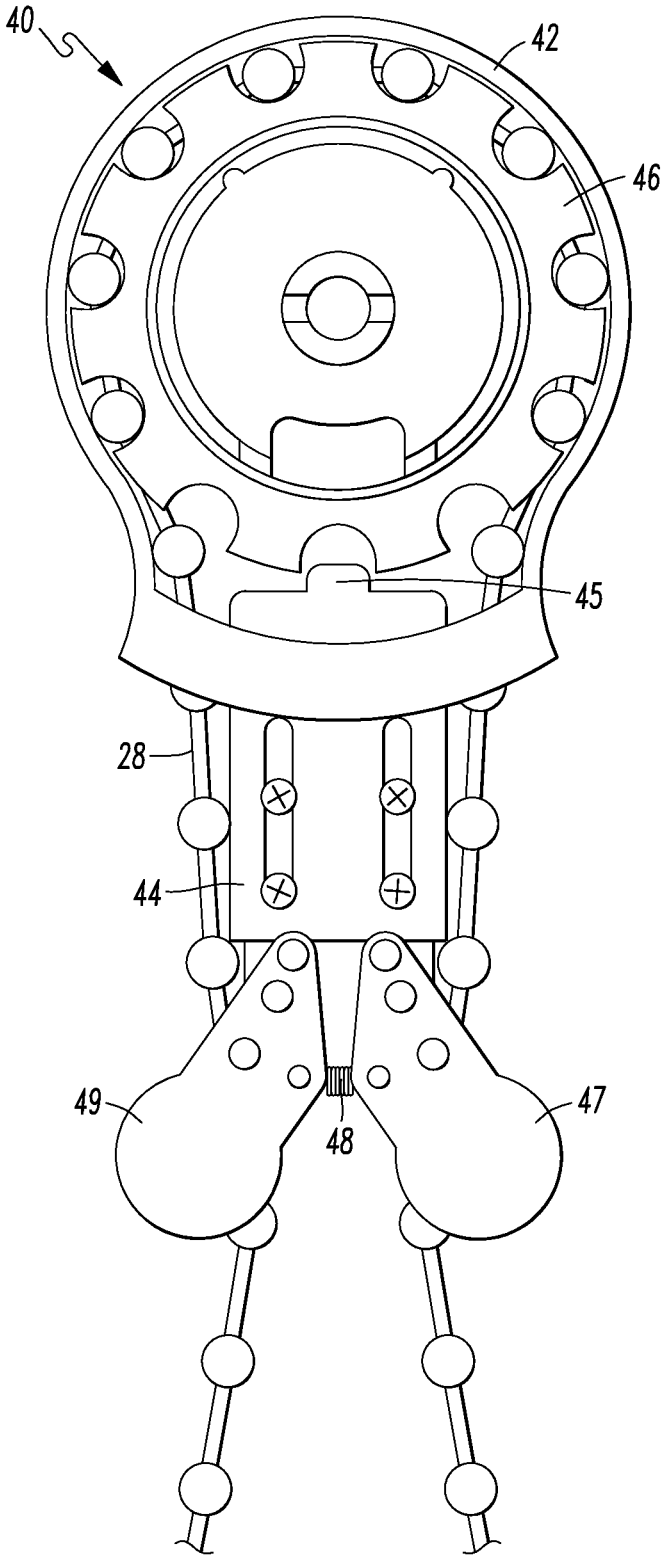
FIG. 7 is a perspective end view of a third present preferred embodiment of a looped cord drive when the tensioner has not been properly installed.
Figure 8:
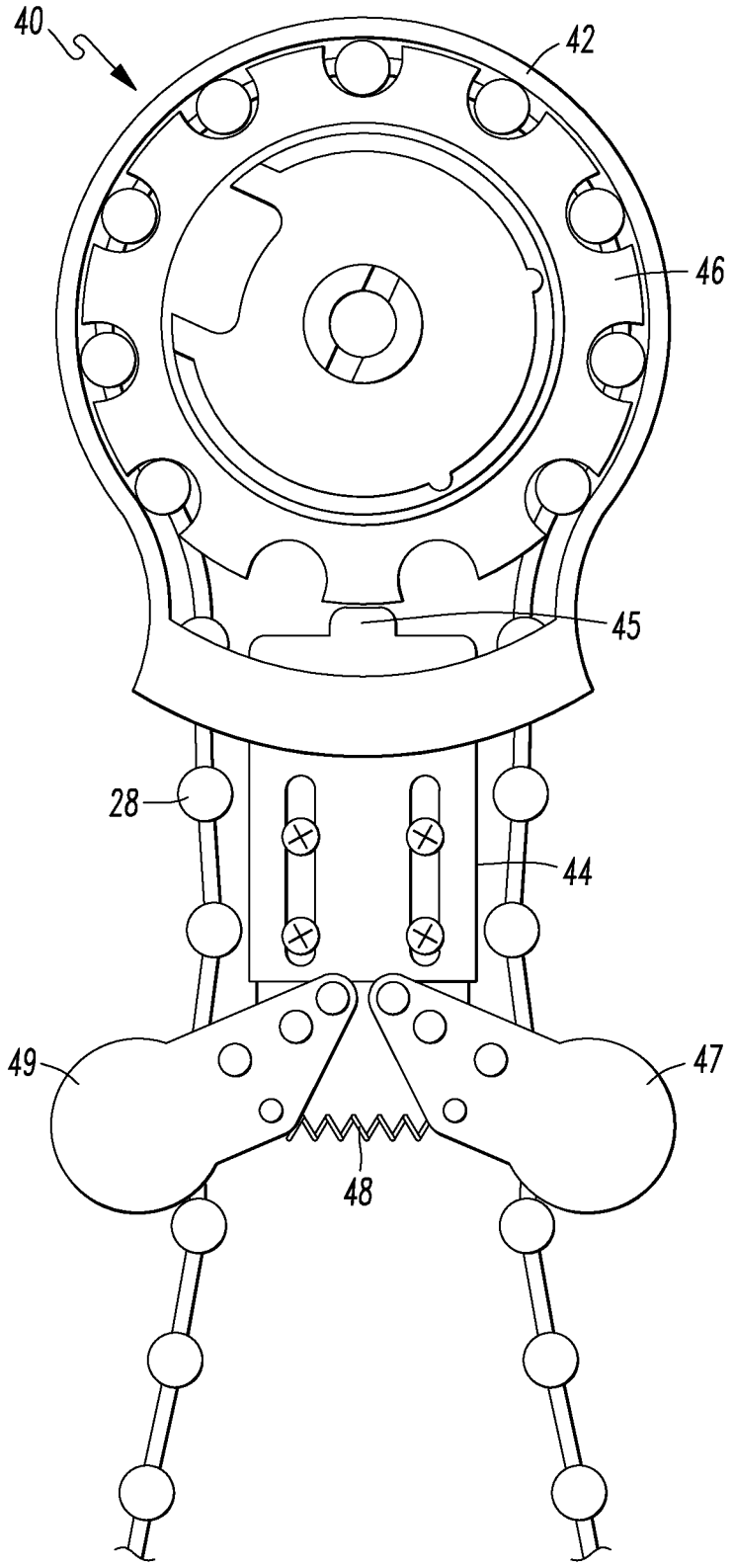
FIG. 8 is a perspective end view of the embodiment shown in FIG. 7 when the tensioner has been properly installed.

Another present preferred embodiment of a looped-cord drive 40 for my of my looped-cord system is shown in FIGS. 7 and 8. As in the previous embodiments there is a sprocket 46 within housing 42. Beaded cord loop 28 passes around the sprocket. I provide a key 44 having a head 45 which will fit between the spokes of the sprocket preventing the sprocket from turning. The key 44 is connected to moveable arms 47 and 49. Spring 48 pulls the arms to the position shown in FIG. 7 in which the head of the key has engaged the sprocket. When the key is in this position the sprocket cannot turn and opposite sides of the beaded cord loop have been pulled together below the sprocket. When the tensioner has been properly installed a force acting on the beaded cord loop causes the opposite sides of the beaded loop cord to move apart. That causes arms 47 and 49 to move to the position shown in FIG. 8. When in that position the key has been moved away from the sprocket so that the head 45 no longer interferes with the sprocket. Consequently, when the tensioner has been properly installed the sprocket can turn and the window covering can be lowered and raised. When the sprocket has not been properly installed as in FIG. 7, the window covering is not operable.

While I have shown certain present preferred embodiments of my looped-cord system and drive units which can be used in that system it should be distinctly understood that the invention is not limited thereto but may be variously embodiment within the scope of the following claims.

I claim:

1. A drive unit for a looped cord system comprising:

a housing;

a sprocket attached to the housing;

a beaded cord loop comprised of beads connected in series to form a loop with a space between each pair of adjacent beads, the beaded cord loop hung on the sprocket such that there will be two portions of the beaded cord loop adjacent to and not engaging the sprocket which two portions will be parallel to one another when no force acts on those portions of the beaded cord loop;

a stop attached to the housing;

a resilient finger opposite the stop, the resilient finger pushing one of the two portions of the beaded cord loop adjacent to and not engaging the sprocket against the stop, thereby preventing movement of the beaded cord loop, and the two portions of the beaded cord loop are not parallel to one another;

wherein applying tension to the beaded cord loop will overcome the pushing of the resilient finger and move the beaded cord loop away from the stop enabling movement of the beaded cord loop; and a tensioner that is configured to be mounted to a non-movable structure such that the tensioner is spaced apart from the housing when the tensioner is mounted, the tensioner sized and configured such that a segment of the beaded cord loop passes along a portion of the tensioner such that the beaded cord loop extends from the housing to the tensioner and has two parallel spaced apart segments linearly extending from the housing to the tensioner when the tensioner is mounted to the structure;

a shroud that is positioned between the housing and the tensioner to surround a portion of each of the two parallel spaced apart segments of the beaded cord loop that extends from the housing to the tensioner when the tensioner is mounted to the structure;

the tensioner, sprocket, stop, finger and housing arranged such that the beaded cord loop is tensioned when the tensioner is mounted to the structure such that the beaded cord loop is under tension that overcomes the pushing of the resilient finger to prevent the resilient finger from pushing the beaded cord loop against the stop to enable movement of the beaded cord loop.

2. The drive unit for a looped-cord system of claim 1 also comprising a clutch attached to the sprocket.

3. The drive unit for a looped-cord system of claim 1 wherein the stop is sized to fit within the space between a pair of adjacent beads.

4. The drive unit for a looped-cord system of claim 1 wherein the stop is a first stop and the resilient finger is a first resilient finger, the drive unit also comprising:

a second stop attached to the housing;

a second resilient finger opposite the second stop, the second resilient finger pushing another one of the two portions of the beaded cord loop adjacent to and not engaging the sprocket against the second stop, thereby preventing movement of the beaded cord loop, and the two portions of the beaded cord loop are not parallel to one another; and wherein applying tension to the cord loop will overcome the pushing of the second resilient finger and move the beaded cord loop away from the stop enabling movement of the beaded cord loop;

the second stop, and second resilient finger arranged such that the beaded cord loop is tensioned when the tensioner is mounted to the structure such that the beaded cord loop is under tension that overcomes the pushing of the second resilient finger to prevent the second resilient finger from pushing the beaded cord loop against the second stop to enable movement of the beaded cord loop.

5. The drive unit for a looped-cord system of claim 1 wherein a portion of the resilient finger or the stop is sized to fit within the space between a pair of adjacent beads.

6. A looped-cord system comprising:

a housing;

a sprocket attached to the housing;

a beaded cord loop comprised of beads connected in series to form a loop with a space between each pair of adjacent beads, the beaded cord loop hung on the sprocket such that there will be two portions of the beaded cord loop adjacent to and not engaging the sprocket which two portions will be parallel to one another when no force acts on those portions of the beaded cord loop;

a stop attached to the housing;

a resilient finger opposite the stop, the resilient finger configured to push one of the two portions of the beaded cord loop adjacent to and not engaging the sprocket against the stop to prevent movement of the beaded cord loop, and the two portions of the beaded cord loop are not parallel to one another;

wherein applying tension to the cord loop will overcome the pushing of the resilient finger and move the beaded cord loop away from the stop enabling movement of the beaded cord loop; and a tensioner on the beaded cord loop that is mounted to a non-movable structure such that the tensioner is spaced apart from the housing, the tensioner sized and configured such that the beaded cord loop extends from the housing to the tensioner and has two parallel spaced apart segments linearly extending from the housing to the tensioner; and the tensioner, sprocket, stop, finger and housing arranged such that the beaded cord loop is tensioned when the tensioner is mounted to the structure such that the beaded cord loop is under tension that overcomes the pushing of the resilient finger to prevent the resilient finger from pushing the beaded cord loop against the stop to enable movement of the beaded cord loop.

7. The looped-cord system of claim 6 also comprising a clutch attached to the sprocket.

8. The looped-cord system of claim 6 wherein the stop is sized to fit within the space between a pair of adjacent beads.

9. The looped-cord system of claim 6 wherein the stop is a first stop and the resilient finger is a first resilient finger, the looped-cord system also comprising:

a second stop attached to the housing;

a second resilient finger opposite the second stop, the second resilient finger configured to push another one of the two portions of the beaded cord loop adjacent to and not engaging the sprocket against the second stop to prevent movement of the beaded cord loop, and the two portions of the beaded cord loop are not parallel to one another; and wherein applying tension to the beaded cord loop will overcome the pushing of the second resilient finger and move the beaded cord loop away from the stop enabling movement of the beaded cord loop; and the second stop and second finger arranged such that the beaded cord loop is tensioned when the tensioner is mounted to the structure such that the beaded cord loop is under tension that overcomes the pushing of the second resilient finger to prevent the second resilient finger from pushing the beaded cord loop against the second stop to enable movement of the beaded cord loop.

10. The looped-cord system of claim 6 wherein the resilient finger or the stop is sized to fit within the space between a pair of adjacent beads.

11. The looped-cord system of claim 6 also comprising a shroud positioned between the tensioner and the housing to surround a portion of each of the two parallel spaced apart segments of the beaded cord loop that extends from the housing to the tensioner when the tensioner is mounted to the structure.

12. A drive unit for a looped-cord system comprising:

a housing;

a sprocket attached to the housing;

a beaded cord loop comprised of beads connected in series to form a loop with a space between each pair of adjacent beads, the beaded cord loop hung on the sprocket such that there will be two portions of the beaded cord loop adjacent to and not engaging the sprocket which two portions will be parallel to one another when no force acts on those portions of the beaded cord loop;

a stop connected to the housing, the stop sized to fit within the space between a pair of adjacent beads;

a biasing member opposite the stop, the biasing member configured to push the stop or push one of the two portions of the beaded cord loop adjacent to and not engaging the sprocket so that the stop is within a space between a pair of adjacent beads, thereby preventing movement of the beaded cord loop, and the two portions of the beaded cord loop are not parallel to one another;

wherein applying tension to the cord loop will overcome the pushing of the biasing member and separate the beaded cord loop and the stop enabling movement of the beaded cord loop; and a tensioner that is configured to be mounted to a non-movable structure such that the tensioner is spaced apart from the housing when the tensioner is mounted, the tensioner sized and configured such that a segment of the beaded cord loop passes along a portion of the tensioner such that the beaded cord loop extends from the housing to the tensioner and has two parallel spaced apart segments linearly extending from the housing to the tensioner when the tensioner is mounted to the structure;

a shroud that is positioned between the tensioner and the housing to surround a portion of each of the two parallel spaced apart segments of the beaded cord loop that linearly extends from the housing to the tensioner when the tensioner is mounted to the structure;

the tensioner, sprocket, stop, biasing member and housing arranged such that the beaded cord loop is tensioned when the tensioner is mounted to the structure such that the beaded cord loop is under tension that overcomes the pushing of the biasing member such that the stop is maintained in a position that is outside of the space between the pair of adjacent beads to enable movement of the beaded cord loop when the tensioner is mounted to the structure.

13. The drive unit for a looped-cord system of claim 12 also comprising a clutch attached to the sprocket.

14. A looped cord system comprising:

a housing;

a sprocket attached to the housing;

a beaded cord loop comprised of beads connected in series to form a loop with a space between each pair of adjacent beads, the beaded cord loop hung on the sprocket such that there will be two portions of the beaded cord loop adjacent to and not engaging the sprocket which two portions will be parallel to one another when no force acts on those portions of the beaded cord loop;

a stop connected to the housing, the stop sized to fit within the space between a pair of adjacent beads;

a biasing member opposite the stop, the biasing member configured to push the stop or push one of the two portions of the beaded cord loop adjacent to and not engaging the sprocket so that the stop is within a space between a pair of adjacent beads, thereby preventing movement of the beaded cord loop, and the two portions of the beaded cord loop are not parallel to one another;

wherein applying tension to the cord loop will overcome the pushing of the biasing member and separate the beaded cord loop and the stop enabling movement of the beaded cord loop; and a tensioner on the cord loop that is mounted to a non-movable structure such that the tensioner is spaced apart from the housing, the beaded cord loop extending from the housing to the tensioner and has two parallel spaced apart segments linearly extending from the housing to the tensioner;

the tensioner, sprocket, stop, biasing member and housing arranged such that the beaded cord loop is tensioned when the tensioner is mounted to the structure such that the beaded cord loop is under tension that overcomes the pushing of the biasing member such that the stop is maintained in a position that is outside of the space between the pair of adjacent beads to enable movement of the beaded cord loop when the tensioner is mounted to the structure.

15. The looped cord system of claim 14 also comprising a shroud positioned between the housing and the tensioner to surround a portion of each of the two parallel spaced apart segments of the beaded cord loop that linearly extends from the housing to the tensioner.

16. A method of mounting a window covering comprising:

providing a window covering, the window covering have a drive unit for a looped cord system comprising:

a housing;

a sprocket attached to the housing;

a beaded cord loop comprised of beads connected in series to form a loop with a space between each pair of adjacent beads, the beaded cord loop hung on the sprocket such that there will be two portions of the beaded cord loop adjacent to and not engaging the sprocket which two portions will be parallel to one another when no force acts on those portions of the beaded cord loop;

a stop attached to the housing;

a resilient finger opposite the stop, the resilient finger configured to push one of the two portions of the beaded cord loop adjacent to and not engaging the sprocket against the stop to prevent movement of the beaded cord loop, and the two portions of the beaded cord loop are not parallel to one another;

wherein applying tension to the beaded cord loop will overcome the pushing of the resilient finger and move the beaded cord loop away from the stop enabling movement of the beaded cord loop; and a tensioner that is configured to be mounted to a non-movable structure such that the tensioner is spaced apart from the housing when the tensioner is mounted, the tensioner sized and configured such that a segment of the beaded cord loop passes along a portion of the tensioner such that the beaded cord loop extends from the housing to the tensioner and has two parallel spaced apart segments linearly extending from the housing to the tensioner when the tensioner is mounted to the structure;

a shroud that is positioned between the housing and the tensioner to surround a portion of each of the two parallel spaced apart segments of the beaded cord loop that linearly extends from the housing to the tensioner when the tensioner is mounted to the structure;

the tensioner, sprocket, stop, finger and housing arranged such that the beaded cord loop is tensioned when the tensioner is mounted to the structure such that the beaded cord loop is under tension that overcomes the pushing of the resilient finger to prevent the resilient finger from pushing the beaded cord loop against the stop to enable movement of the beaded cord loop; and mounting the tensioner to the structure so that the housing and the tensioner are spaced apart from each other such that the beaded cord loop extends from the housing to the tensioner and has two parallel spaced apart segments linearly extending from the housing to the tensioner and the beaded cord loop is tensioned via the mounted tensioner such that the beaded cord loop is under tension that overcomes the pushing of the resilient finger to prevent the resilient finger from pushing the beaded cord loop against the stop to enable movement of the beaded cord loop.

17. The method of claim 16, comprising:

after the mounting of the tensioner, moving the beaded cord loop to cause the sprocket to rotate to actuate adjustment of a position of the window covering.

18. A method of mounting a window covering comprising:

providing a window covering having a drive unit for a looped-cord system comprising:

a housing;

a sprocket attached to the housing;

a beaded cord loop comprised of beads connected in series to form a loop with a space between each pair of adjacent beads, the beaded cord loop hung on the sprocket such that there will be two portions of the beaded cord loop adjacent to and not engaging the sprocket which two portions will be parallel to one another when no force acts on those portions of the beaded cord loop;

a stop connected to the housing, the stop sized to fit within the space between a pair of adjacent beads;

a biasing member opposite the stop, the biasing member configured to push the stop or push one of the two portions of the beaded cord loop adjacent to and not engaging the sprocket so that the stop is within a space between a pair of adjacent beads to prevent movement of the beaded cord loop;

wherein applying tension to the cord loop will overcome the pushing of the biasing member and separate the beaded cord loop and the stop enabling movement of the beaded cord loop; and a tensioner that is configured to be mounted to a non-movable structure such that the tensioner is spaced apart from the housing when the tensioner is mounted, the tensioner sized and configured such that a segment of the beaded cord loop passes along a portion of the tensioner such that the beaded cord loop extends from the housing to the tensioner and has two parallel spaced apart segments linearly extending from the housing to the tensioner when the tensioner is mounted to the structure;

a shroud that is positioned between the tensioner and the housing to surround a portion of each of the two parallel spaced apart segments of the beaded cord loop that linearly extends from the housing to the tensioner when the tensioner is mounted to the structure;

the tensioner, sprocket, stop, biasing member and housing arranged such that the beaded cord loop is tensioned when the tensioner is mounted to the structure such that the beaded cord loop is under tension that overcomes the pushing of the biasing member such that the stop is maintained in a position that is outside of the space between the pair of adjacent beads to enable movement of the beaded cord loop when the tensioner is mounted to the structure; and mounting the tensioner to the structure such that the beaded cord loop extends from the housing to the tensioner and has two parallel spaced apart segments linearly extending from the housing to the tensioner when the tensioner is mounted to the structure and the beaded cord loop is under tension that overcomes the pushing of the biasing member such that the stop is maintained in a position that is outside of the space between the pair of adjacent beads to enable movement of the beaded cord loop when the tensioner is mounted to the structure.

19. The method of claim 18, comprising:

moving the beaded cord loop to cause the sprocket to rotate to actuate adjustment of a position of the window covering after the mounting of the tensioner.

* * * * *